United States Patent [19]

Rice

[11] Patent Number: 4,464,852

[45] Date of Patent: Aug. 14, 1984

[54] DOZER ATTACHMENT FOR EXCAVATOR

[75] Inventor: Dennis A. Rice, Dubuque, Iowa

[73] Assignee: Deere & Company, Moline, Ill.

[21] Appl. No.: 511,601

[22] Filed: Jul. 7, 1983

[51] Int. Cl.[3] ..... E02F 3/76

[52] U.S. Cl. ..... 37/117.5; 172/826; 172/811; 37/DIG. 12

[58] Field of Search ..... 37/117.5, 234, 279, 37/DIG. 3; 172/811, 817, 818, 819, 825, 826, 828

[56] References Cited

U.S. PATENT DOCUMENTS

| | | | |
|---|---|---|---|
| 2,649,794 | 8/1953 | Wood | 172/826 |
| 3,006,090 | 10/1961 | Gwinn, Jr. | 172/811 |
| 3,246,406 | 4/1966 | Ray, Jr. | 172/826 |
| 3,909,963 | 10/1975 | Patel | 37/117.5 |
| 4,098,350 | 7/1978 | Eftefield | 172/826 |
| 4,167,979 | 9/1979 | Freese et al. | 172/811 |
| 4,199,033 | 4/1980 | Gundy, Jr. | 37/117.5 |

*Primary Examiner*—E. H. Eickholt

[57] ABSTRACT

An excavator has a dozer blade coupled to transversely spaced first and second fore-and-aft extending drive housings thereof by first and second separate push beams having their respective forward ends universally coupled to the blade. The first push beam has its rear end universally connected to the first drive housing while the rear end of the second push beam is connected to the second drive housing by an angling link which is swingable fore-and-aft so as to cause fore-and-aft movement of the second push beam; a length adjustable jack forms a stabilizer strut which is coupled between the first push beam and the blade so as to maintain the latter in a desired pitch. Individual lift actuators are connected to the push beams for selectively adjusting the latter vertically either together or separately. A side load transfer strut is connected between the forward end of the first push beam and the second drive housing.

7 Claims, 3 Drawing Figures

DOZER ATTACHMENT FOR EXCAVATOR

BACKGROUND OF THE INVENTION

The present invention relates to structure for attaching dozer blades to work vehicles and more specifically relates to a structure which is particularly suited for attaching a dozer blade to an excavator.

The idea of making an excavator more versatile by providing it with a dozer blade is known as is evidenced by U.S. Pat. No. 4,315,636 granted to M. Nakagawa on Feb. 16, 1982. The structure disclosed in the patent for attaching the blade to the excavator is quite rudimentary and merely shows a blade fixed rigidly with a frame which is vertically swingably connected to the excavator and a lift actuator for selectively causing vertical movement of the frame. No provision is made for angling, tilting or pitching the blade relative to the frame. Thus, the blade can only perform the most basic of tasks.

While it has long been known to attach dozer blades to crawler tractors by structures which provide for angling, tilting and pitching the dozer blade, these structures lack overall simplicity and are not suitable for connection to an excavator. For example, U.S. Pat. No. 3,991,832 granted to Cooper on Nov. 16, 1976 illustrates one type of structure which comprises a C-frame vertically pivotally mounted to a vehicle main frame and a blade universally connected at its center to the C-frame. A first pair of actuators are operable for raising and lowering the C-frame, a second pair of actuators are operable for angling or pitching the blade and a third actuator for tilting the blade. These blade motions are about its universal connection with the C-frame and the distance the blade is required to be mounted forwardly for providing adequate angling clearance is somewhat excessive. U.S. Pat. No. 3,941,195 issued to Stedman on Mar. 2, 1976 discloses a design which permits the blade to be close coupled to a crawler tractor by using separate push arms connected to the back of the blade and a transverse brace coupled between the tractor frame and one of the arms. However, no means for angling the blade is apparent.

SUMMARY OF THE INVENTION

According to the present invention there is provided an improved structure for attaching a dozer blade to a work vehicle.

It is an object of the invention to provide a relatively simple attaching structure but yet to provide one which allows the blade to be selectively pitched, angled or tilted.

A further object of the invention is to provide a blade attaching structure utilizing separate push arms coupled to the back of the blade and to mount lift cylinders between the work vehicle frame and the push arms such that the actuators may either be extended and retracted in unison to raise and lower both ends of the blade equally or be operated separately so as to tilt the blade for slope control.

A further object of the invention is to provide a blade mounting structure permitting the blade to be angled about its connection with a first push arm by force and aft movement of a second push arm.

These and other objects will become apparent from reading the ensuing description together with the appended drawing.

DESCRIPTION OF THE PREFERRED EMBODIMENT

Figure 1:
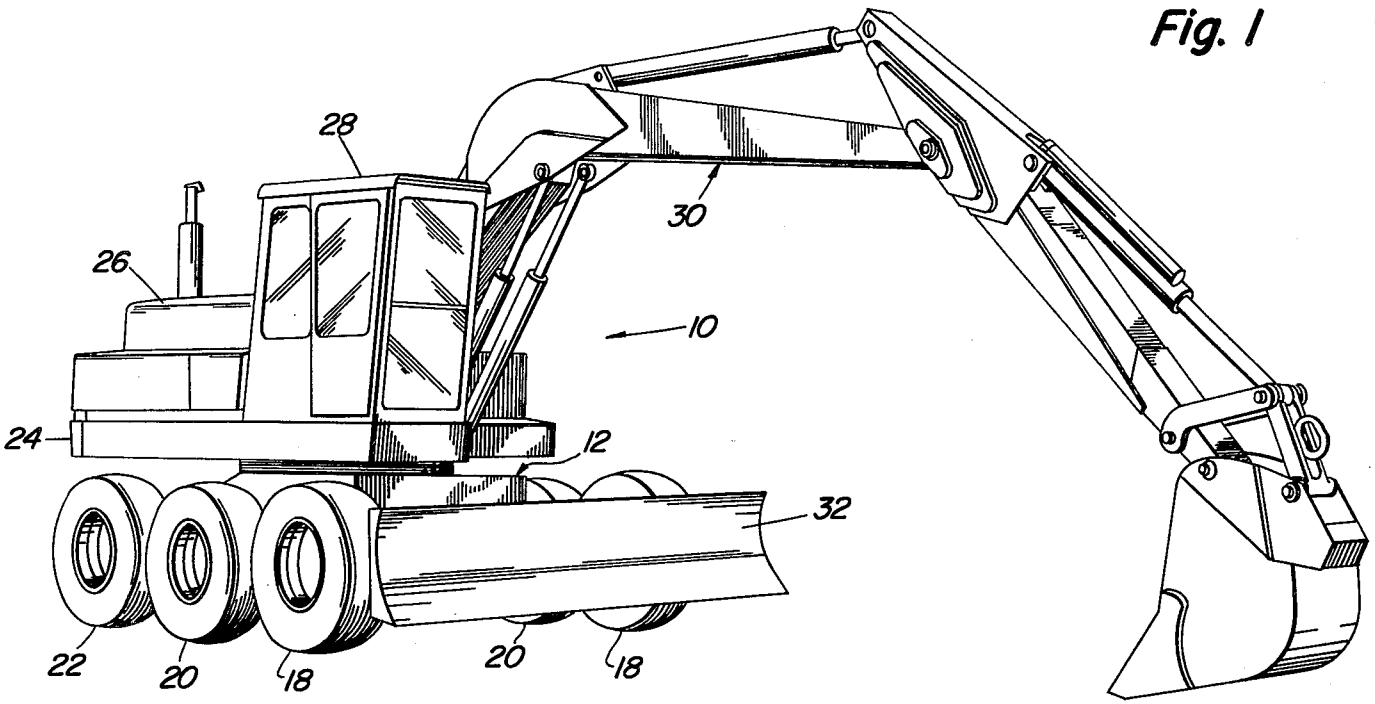
FIG. 1 is a right front perspective view of an excavator with which the presented invention is particularly suited for use.

Referring now to the drawings, there is shown an excavator 10 including a base frame or undercarriage 12 defined in part by right and left-hand, fore and aft extending drive housings 14 and 16. Rotatably mounted in the housings are drive axles (not shown) to which are mounted front, intermidiate and rear pairs of wheels 18, 20, and 22. An upper frame 24 is rotatably mounted to the base 12 in a well known manner (not shown) for permitting the frame 24 to revolve about a vertical axis. The upper frame 24 supports an engine within an enclosure 26, a operator's station 28 and a boom structure 30.

Figure 2:
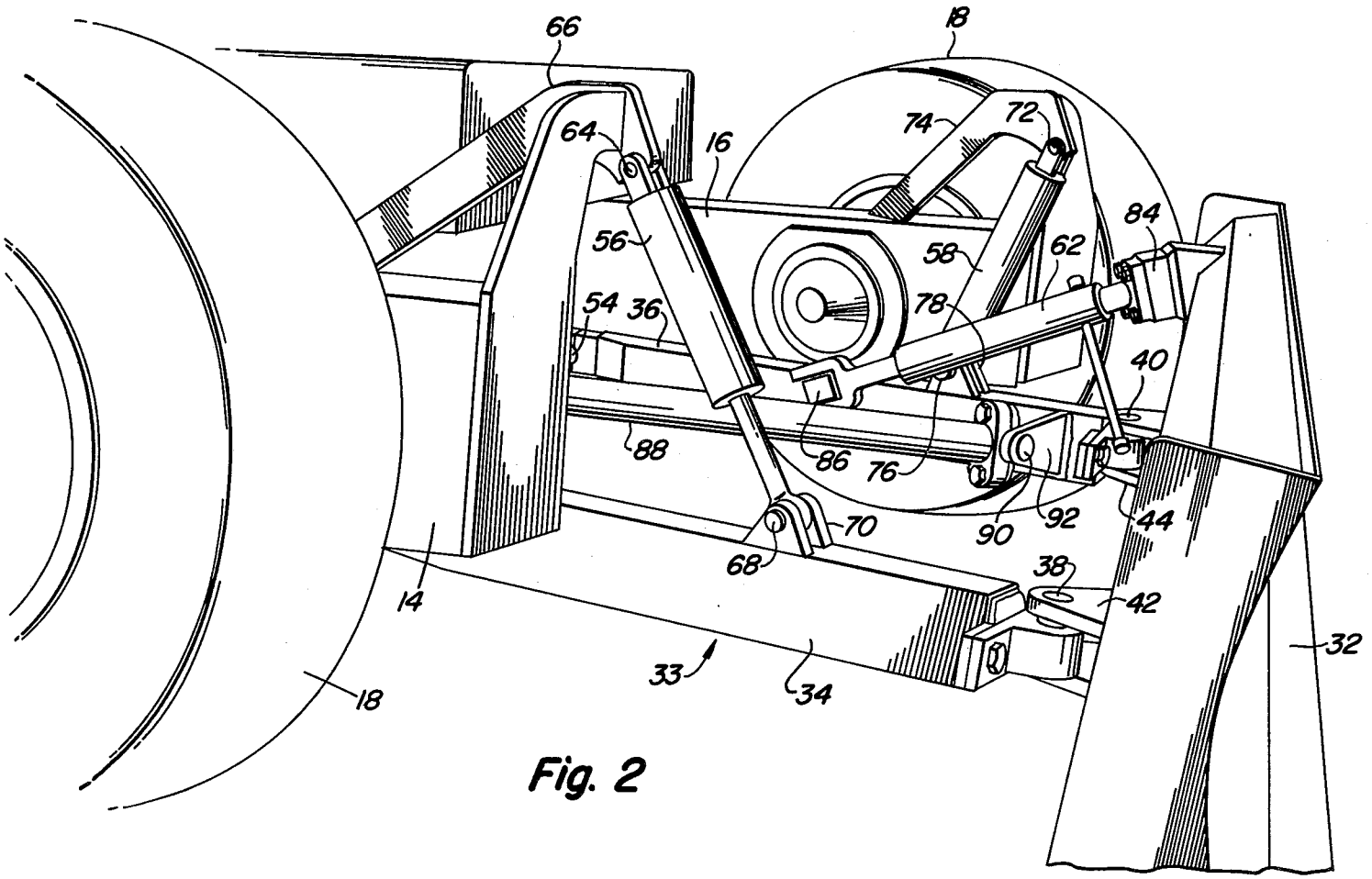
FIG. 2 is a right front perspective view of the blade and attaching structure therefore.
Figure 3:
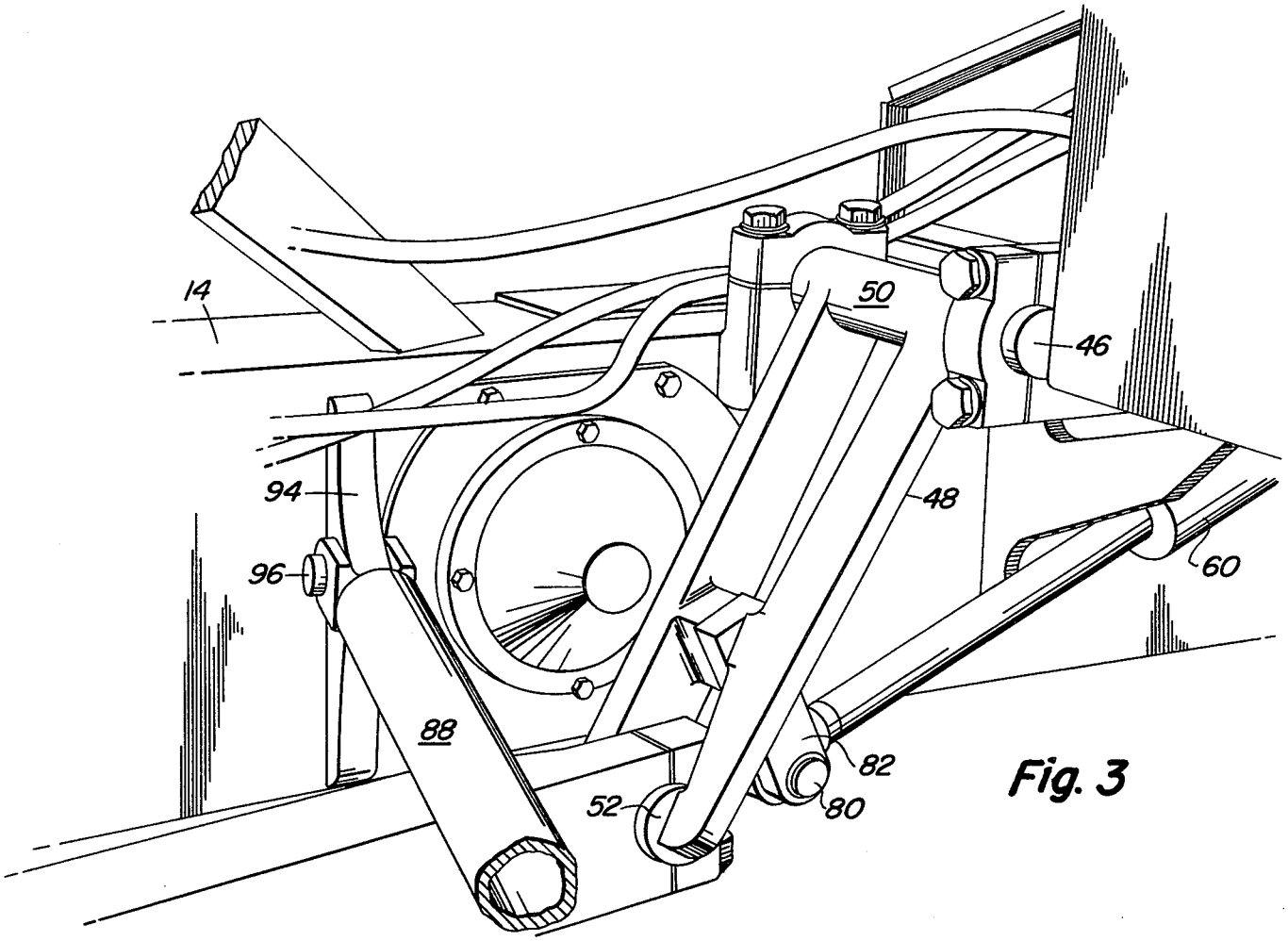
FIG. 3 is a left front perspective view showing the mounting of the right-hand push beam to the right-hand drive housing.

Extending crosswise just forwardly of the front wheels 18 of the excavator is a blade 32. A structure 33 connecting the blade 32 to the drive housings 14 and 16 is shown in FIGS. 2 and 3 and this structure forms the substance of the present invention.

Specifically, the structure 33 includes right and left-hand push beams 34 and 36, respectively, having their forward ends universally connected to vertical pins 38 and 40, respectively, received in clevises 42 and 44 fixed to the lower back side of the blade 24. Fixed inside of the drive housing 14 at a location just rearwardly and above the axis of rotation of the right-hand one of the pair of front wheels 18 is a horizontal, transverse pivot pin 46. An angling link 48 has a sleeve 50 at its upper end journalled on the pin 46 and has a horizontal, transverse pin 52 fixed to its lower end. The rear end of the push beam 34 is pivotally connected to the pin 52. Fixed to the inside of the drive housing 16 at a location rearwardly and below the axis of rotation of the left-hand one of the pair of front wheels 18 is a horizontal transverse pivot pin 54. The rear end of the push beam 36 is pivotally connected to the pin 54. Provided for controlling the blade 32 are right and lefthand hydraulic lift actuators 56 and 58, respectively, a hydraulic angle actuator 60 (FIG. 3) and a pitch jack 62 (FIG. 2). The lift actuator 56 has its head end pivotally connected, as at a pin 64, to a bracket 66 fixed to the forward end portion of the drive housing 14. The rod end of the actuator 56 is pivotally connected, by a pin 68, to a lug 70 fixed to the top of the push beam 34. The lift actuator 58 has its head end pivotally connected by a pin 72 to a bracket 74 fixed to the forward end portion of the drive housing 16. The rod end of the actuators 58 is pivotally connected, by a pin 76, to a lug 78 fixed to the top of the push beam 36.

The angle actuator 60 has its rod end pivotally connected, as by a pin 80, to a lug 82 welded to and projecting rearwardly from the angling link 48 and has its rear end pivotally connected to a clevis structure (not shown) fixed to the inside of the drive housing 16.

The pitch jack 62 has its forward end universally connected, as at 84, to the top backside of the blade 32 at a location axially aligned with the vertical pin 40 connecting the push bem 36 to the blade. The rear end of the jack 62 is pivotally connected to a lug 86 fixed to the inside of the beam 36.

Side loads imposed on the blade are absorbed by an elongate strut 88 having its forward end universally connected to a horizontal pin 90 recieved in a clevis 92 fixed to the inside of the beam 36 at a location adjacent the forward end thereof. A lug 94 is fixed to the inside of the drive housing 14 at a midheight location forwardly of the axis of rotation of the front pair of wheels 18. The strut 88 is angled across to and has its rear end pivotally connected to the lug 94 by a pin 96. The strut 88 is elevated a distance sufficiently above the push beam 34 to permit the latter to be raised without interference.

The blade 32 is shown in a fully angled condition in FIG. 2, with the angling actuator 60 and link 48 being correspondingly positioned in FIG. 3. The geometry of the link 48 and the lift actuator 58 and 56 relative to the push beams 34 and 36 are such that the blade 32 is at the same height when in its unangled condition with both ends closely adjacent the wheels 18 and when in its fully angled position, as shown.

Because the beams 34 and 36 are separate from each other, it is possible to tilt the blade 32 for slope control by separately controlling the actuators 56 and 58.

I claim:

1. In combination with an excavator having an undercarriage defined in part by first and second transversely spaced, fore-and-aft extending drive housings, a blade and attachment structure comprising: said blade extending transversely adjacent first ends of the drive housings; first and second fore and aft extending push beams respectively positioned alongside inner surfaces of the first and second drive housings; said first push beam having opposite ends universally connected to the inner surface of the first drive housing and a lower back location of the blade; said second push beam having its forward end universally connected to another lower back location of the blade; an angling link having a lower end universally connected to a rear end of the second push beam and having an upper end pivotally connected to the second drive housing for movement about a horizontal transverse axis; first and second lift actuators respectively positioned above the first and second push beams and respectively connected between the first drive housing and the first push beam and between the second drive housing and the second push beam; and a stabilizer strut having a forward end universally connected to the blade at a location above and in vertical alignment with the connection of the first push beam with the blade, to thereby define a blade angle axis and having a rearward end pivotally connected to the first push beam.

2. The combination defined in claim 1 wherein the stabilizer strut is selectively length adjustable for varying the pitch of the blade.

3. The combination defined in either claim 1 or 2 wherein a side load transfer strut has a forward end universally connected to a forward end location of the first push beam and a second end pivotally connected to the second drive housing at a location rearwardly of the second lift actuator.

4. The combination defined in claim 1 wherein respective upper ends of the first and second actuators are coupled to the first and second housings by way of first and second upstanding brackets fixed rigedly to the first and second housings; and said first and second lift actuators and said angle link having geometrical relationships to each other which result in the blade being at the same height in angled and non-angled positions.

5. In a work vehicle having a main frame and a dozer blade connected to the main frame by an attachment structure, the improvement wherein said attachment structure comprises: first and second, transversely spaced fore-and-aft extending push beams; a universal connecting means securing the rear end of the first push beam to the main frame; a link means connecting the rear end of the second push beam to the main frame for fore-and-aft movement; second and third universal connecting means respectively connecting the forward ends of the first and second push beams to the blade; a stabilizer strut; fourth universal connecting means connecting one end of the strut to the blade at a location above and vertically aligned with the second universal connecting means, and pivot means connecting another end of the strut to the first push beam; first and second lift actuators connected between the main frame and the first and second push beams; and an angle actuator connected between the frame and an assembly comprised of the link means and second push beam for effecting fore-and-aft movement of said assembly for angling the blade about said second and fourth universal connections.

6. The work vehicle defined in claim 1 wherein a side load transfer strut is connected between the first push beam and the frame.

7. A structure attaching a dozer blade to a vehicle frame comprising: a first push beam having its opposite ends universally connected to the vehicle frame and to the blade at a lower back location adjacent a first end of the blade; a first extensible and retractable hydraulic actuator connected between the frame and the first push beam; a second push beam spaced transversely from the first push beam and having its forward end universally connected to the blade at a lower back location adjacent a second end of the blade; an angle link having one end pivotally coupled to the frame for fore-and-aft swinging movement and another end universally coupled to a rear end of the second push beam; an extensible and retractable angle actuator coupled between the frame and the angle link and being operable for swinging the link to thereby effect angling of the blade about its universal connection with the first push beam; a second extensible and retractable actuator coupled between the frame and the second push beam.

* * * * *